United States Patent [19]

Alviti

[11] 4,358,976

[45] Nov. 16, 1982

[54] CHAIN CUTTING MACHINE

[75] Inventor: Steven R. Alviti, Narragansett, R.I.

[73] Assignee: Bel Air Tool Corp., Warwick, R.I.

[21] Appl. No.: 228,689

[22] Filed: Jan. 26, 1981

[51] Int. Cl.[3] ..... B26D 7/00

[52] U.S. Cl. ..... 83/66; 83/175; 83/234; 83/245; 83/277

[58] Field of Search ..... 83/66, 175, 234, 245, 83/277

[56] References Cited

U.S. PATENT DOCUMENTS 3,667,662 6/1972 Gilford et al. ..... 83/277 X 3,973,456 8/1976 Suzuki et al. ..... 83/925 R 4,041,814 8/1977 High ..... 83/175 X

*Primary Examiner*—James M. Meister

*Attorney, Agent, or Firm*—Salter & Michaelson

[57] ABSTRACT

A chain cutting machine particularly adapted to repeatedly cut chain to a preselected length segment in a convenient trouble free manner. The particular length of cut chain segments may also be varied. The machine is particularly adapted for use in the jewelry industry wherein chain suitable for necklaces and the like may be automatically and repetitively cut to the preselected length desired.

9 Claims, 12 Drawing Figures

FIG. 11
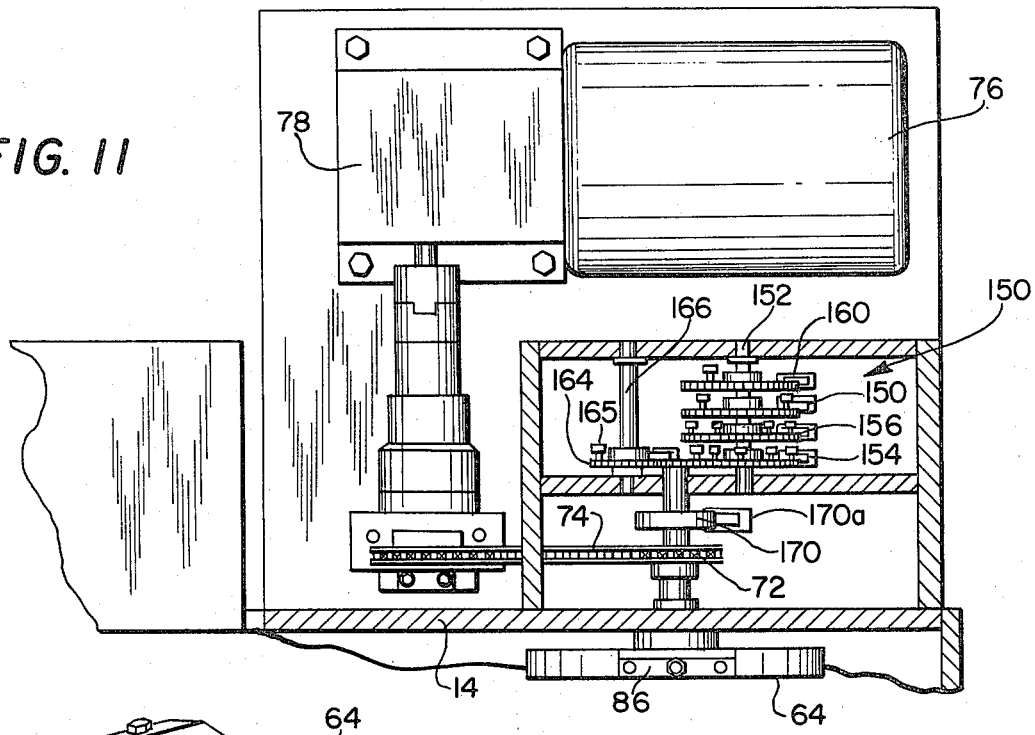
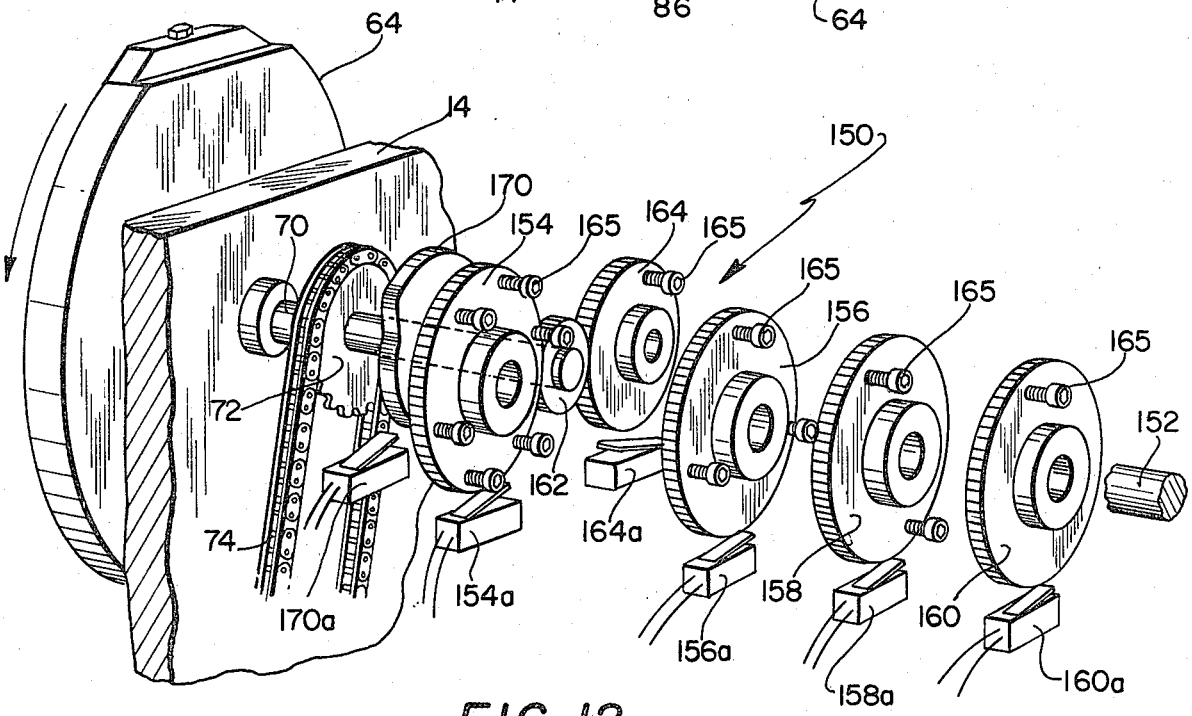
FIG. 12

CHAIN CUTTING MACHINE

BACKGROUND AND SUMMARY OF THE INVENTION

This invention relates to a device for automatically cutting strand and particularly chain adapted for decorative jewelry uses from a continuous supply thereof such as a wound reel. Presently, such jewelry chain is primarily cut by hand. In addition to involving high labor costs, such practice also produces the possibility of measurement error especially when the length of the strand to be cut is a multiple of the measuring rule, i.e., when it is desired to cut 52 inch chain segments while using a 12 inch rule since repetitive measuring steps are involved.

Such machines generally utilize some mechanism which grabs the chain and draws it a measured distance or length in relation to a fixed point and then effects the cutting thereof. Applicant is aware of the following U.S. patents which are thought to be of some interest in regard to machines of this overall type, namely, U.S. Pat. Nos. 1,341,184; 2,287,833; 2,852,285; 3,667,662; 3,735,907; 3,857,313; 3,973,456. The citation of these patents constitutes applicant's Prior Art Statement.

Some attempts have been made to introduce automatic cutting machinery in this field but the need still exists for a reliable and flexible machine which can automatically, repeatedly and accurately cut the desired length of chain from a supply thereof, and which additionally does such at a relatively high rate of speed. In addition, the need also exists for a machine which can accomplish the above results and which is highly adjustable in regard to the length of chain which it cuts even when such length of chain involves multiples of the measurement scale utilized by such machines.

These and other objects of the present invention are accomplished by a machine for cutting strand material such as chain to a variable and predetermined length comprising a frame, a plate mounted on said frame for vertical reciprocation relative thereto between upper and lower positions, an open ended tube mounted on said plate and adapted to receive chain from a chain supply assembly supported by said frame and in turn adapted to supply chain to the open upper end of said tube, chain pulling means mounted on said plate and adapted to grip chain emerging from the bottom end of said tube when said plate is at said upper position thereof so as to pull a selected length of said chain through said tube during the downward travel of said plate and to release said chain at the lower position of said plate, a chain cutting assembly supported by said frame and adapted to move in conjunction with said plate and adapted to sever a predetermined length of said chain from the supply thereof, and means for varying the reciprocal travel of said plate relative to said frame so as to vary the length of chain pulled from said supply on each reciprocal cycle thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 11 is a top planar view of the machine with parts broken away and sectioned for clarity; and FIG. 12 is an enlarged perspective view showing the operation of the control assembly of the present machine.

DESCRIPTION OF THE INVENTION

Figure 1:
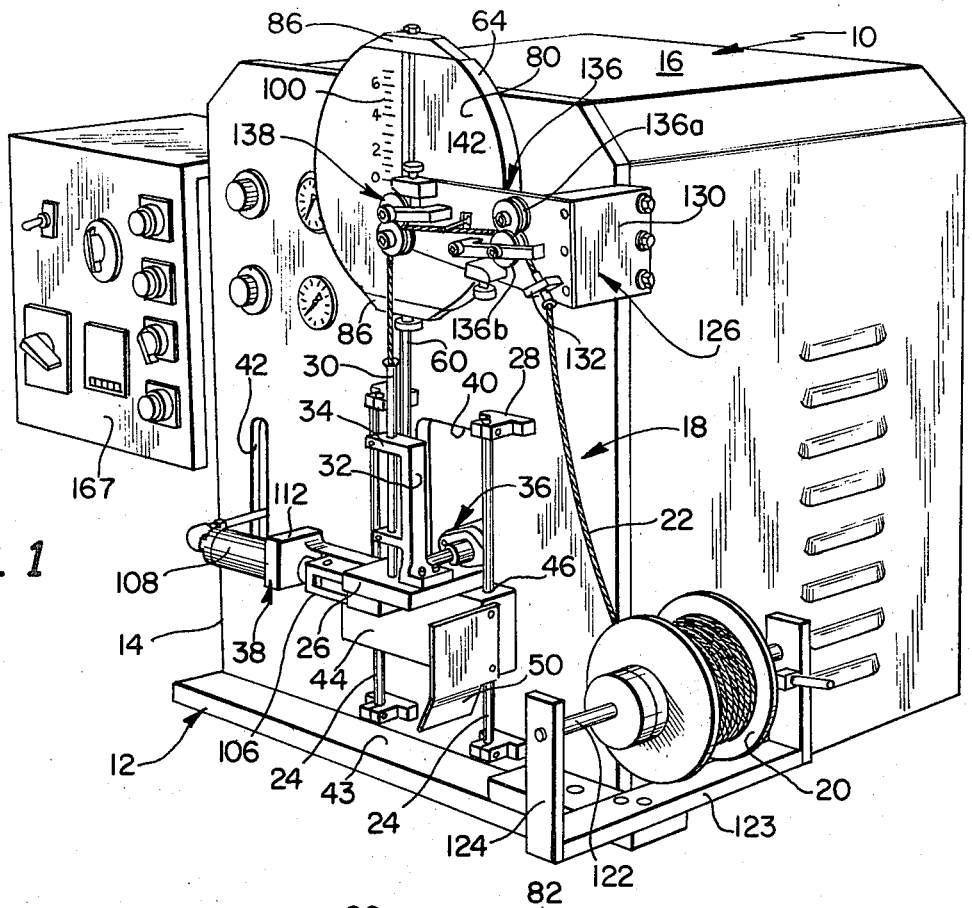
FIG. 1 is an overall perspective view of a machine incorporating the novel features of the present invention.

Referring to the drawings and particularly FIGS. 1 through 3 and 10 thereof, the overall configuration of the chain cutting machine 10 of the present invention is shown. Such includes a frame 12 including an upright front support 14 from which a housing or cover 16 rearwardly extends. A chain supply assembly 18 is mounted on the frame and includes a reel 20 on which a continuous length of chain 22 is wound and forms the supply thereof to be cut into predetermined incremental lengths in accordance with the objects of the invention.

The upright support 14 includes a pair of parallel, vertically disposed guide rods 24 on which a plate member 26 is adapted to slide for vertical reciprocal movement with respect of the frame 12 and support 14. The guide rods 24 are attached to the upright support 14 by means of the holding elements 28, as shown. The plate 26 in turn supports an upright tube 30 open at both opposite ends thereof and supported in a vertical disposition by means of a bracket 32 having vertically spaced arms 34 to which the tube 30 is secured.

The plate 26 also supports a chain pulling assembly 36 as well as a chain cutting assembly 38 which are adapted to move within the confines of slots 40 and 42 respectively as the plate 26 reciprocates up and down on the rods 24. The overall operation of the device 10 is such that the uncut chain is fed into the upper open end of the tube 30 by means of the chain supply assembly 18 and through the bottom open end of the tube from which it extends. The portion of the chain extending below the tube is grasped by the chain pulling assembly 36 at the upper stroke of the plate 26 such that as the plate 26 moves downwardly it draws the chain with it. When the plate 26 reaches its lowermost point of travel, the chain pulling assembly 36 is released such that on the return upward movement of the plate 26, the length of chain 22 previously drawn downwardly on the down stroke movement of the plate remains essentially undisturbed in such position. Accordingly, the length of travel of the plate 26 determines how much chain is drawn from the supply assembly 18 such that when the desired length of chain has been drawn through the tube either by a single or multiple cycles of the plate 26, the chain cutting assembly 38 is activated so as to cut the chain. After the chain is cut, it falls by gravity into a receiving area 42.

The plate 26 includes a base portion 44 in turn provided with aligned vertical bores 46 for receipt of the guide rods 24. The plate 26 may be integral with such base 44 or attached thereto by bolts and the like. The plate 26 includes an opening or bore 48 passing therethrough and vertically aligned with the tube 30 such that the lower open end of the tube is vertically spaced from the upper end of the bore 48. The lower end of the chain passing through the tube is adapted to extend or hang downwardly through said bore 48. The base 44 may further be provided with a deflector element 50 such that when the chain is severed by the chain cutting assembly 38, it is directed to the receiving area which may include a bin, a take away belt or the like.

Figure 10:
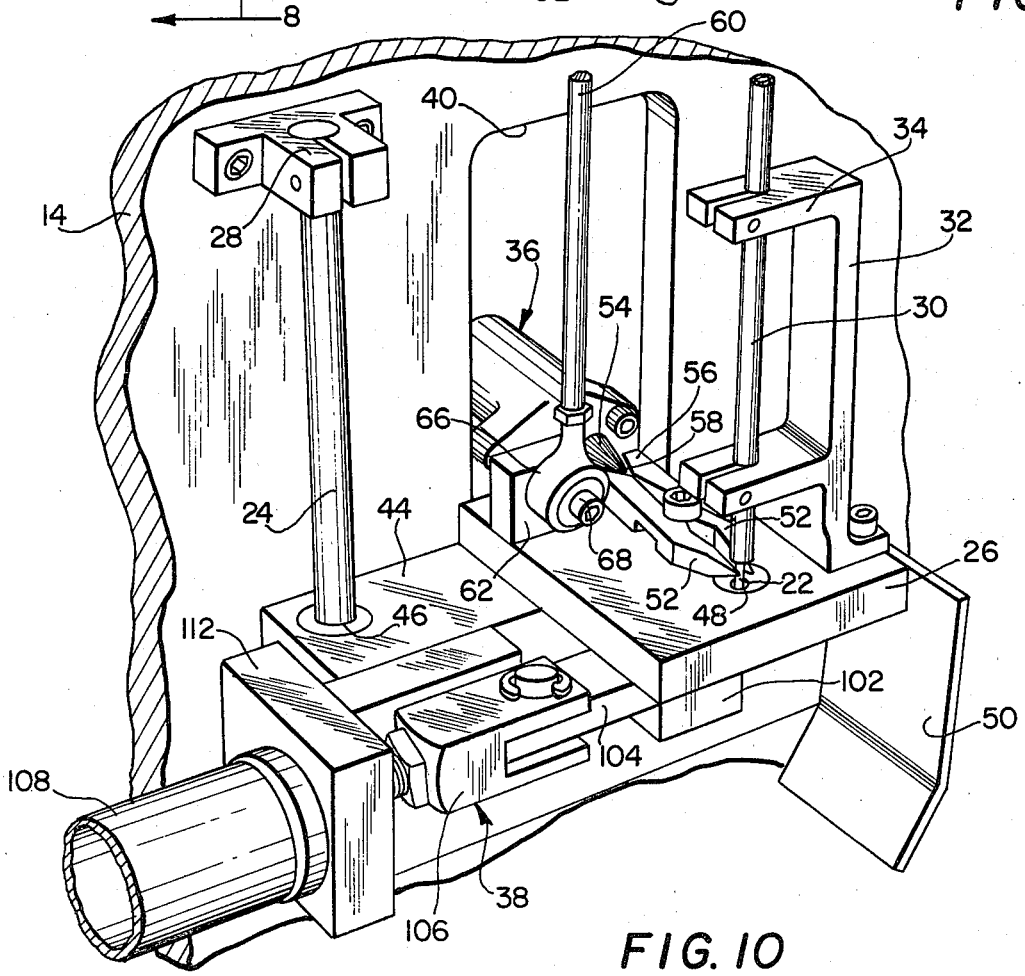
FIG. 10 is a front perspective view on an enlarged scale of a portion of the machine and particularly illustrates the manner in which a chain is grasped and cut in the intended manner.

As best shown by FIG. 10 of the drawing, the chain pulling assembly 36 includes a pair of scissor-like pivoted gripping elements or jaws 52 which are normally spring or otherwise biased to an open non-gripping position. The jaws 52 may be forced to a closed or gripping position by means of a driving element 54 adapted to be forced between rearward extensions 56 of the gripping elements 52 and which in turn are provided with opposed wedge-shaped cam surfaces 58. Thus, as the driving element 54 is forced against the cam surfaces 58, it forces the rearward extensions apart so as to force the gripping elements 52 towards each other such that they firmly grip the chain 22 extending into the space between the upper surface of the plate 26 and the lower open end of the tube 30. Such gripping action may be regulated by the extent the driving member 54 is driven into engagement with the elements 56 and is controlled such that gripping is activated when the plate is at the upper extent of its travel. Such travel, that is, the up and down movement imparted to the plate 26, is achieved by means of a crank arm 60 attached at its lower end to a block 62. The block upwardly extends and is fixedly connected to the plate 26. The crank arm 60 is attached at its upper end to a rotating disc 64. The lower end of the crank arm 60 terminates in a conventional knuckle 66 through which a pin 68 serves to connect the crank arms 60 to the block 62 yet permit relative rotation of the knuckle 66 with respect thereto.

The disc 64 is adapted for continual rotation in a single direction by means of a drive shaft 70 connected thereto and rearwardly extending therefrom through an opening provided in the upright support portion 14 of the frame 12. The drive shaft 70 includes a drive gear 72 over which a drive chain 74 is trained and thence to a motor 76 through appropriate coupling 78 such that the disc 64, as previously mentioned, may be continually rotated in the clockwise direction as shown in the drawings. The outer face 80 of the disc 64 is provided with an inwardly and diametrically extending slot or groove 82. A threaded rod 84 is supported at opposite ends of such slot 82 by means of end plates 86, that is, the disc 64 may include end plates 86 disposed at the front face 80 thereof and which are in turn provided with bores 88 through which the threaded rod 84 extends. The threaded rod 84 is held in place by means of threaded connecting elements 90 and 91 at opposite ends thereof. The lower element 91 also serves to vary the stroke of the crank arm 60 as will hereinafter be evident.

The upper end of the crank arm 60 is provided with a knuckle element 92 similar to element 66. However, the center pin 94 of the knuckle element 92 inwardly terminates in a threaded sleeve 96 in turn adapted for receipt in the slot or groove 82. The sleeve includes extensions or wings 98 which coact with the opposed undercut walls forming such slot such that the sleeve 96 may move up and down vertically within the groove but is held from rotation by the aforementioned contact with the groove. Accordingly, rotation of the adjustment nut 91 causes the shaft 84 to rotate and thus forces the sleeve 96 up or down within the confines of the slot. The outer face 80 of the disc 64 is preferably provided with indicia starting from a scale of 0 coincident with the rotational axis of the disc 64 and upwardly extending to the periphery thereof. It may thus be apparent that as the point at which the crank arm 60 is connected to the disc 64 moves away from the rotational center thereof, the vertical stroke or travel of the plate 26 will be increased and that such may be readily varied by the aforementioned adjustment mechanism.

The chain cutting assembly 38 is also supported by the plate 26. In that regard, a block 102 having a slot 103 formed in the upper face thereof is affixed to the bottom of the plate 26 such that a cutting element 104 is adapted to extend into such slot for reciprocal motion. The cutting element terminates in a blade 105 and is in turn connected to a bifurcated attachment jaw 106. The jaw 106 is in turn connected to the drive piston of an air actuated drive cylinder 108. The opposite end of the air cylinder is adapted to slide up and down in slot 42 as by means of a guide roller 110 provided for such purpose. The cylinder 108 is mounted in a collar 112 which in turn is connected to the base 44 by any appropriate means such as bolts (not shown). Accordingly, the chain cutting assembly 38 is adapted to move in conjunction with the movement of the plate 26.

At the upper stroke of the crank arm 60, that is, at the upper position of the plate 26, the chain pulling assembly 36 is adapted for activation such that the gripper jaws 52 firmly engage the chain 22. In that position, the chain hangs down through the tube 30 and extends below the plate 26 via the bore 48 provided therethrough. Since the gripping jaws 52 are carried by the plate 26, it will be seen that as the plate moves downwardly it will cause a length of chain equal to the stroke of the crank arm to be pulled downwardly through the tube 30 from the chain supply assembly 18. When the crank has reached the bottom of its stroke, the gripping jaws are automatically opened so that as the plate 26 and the tube 30 attached thereto move upwardly, the chain remains stationary by gravity so that when the plate and the tube have reached their uppermost position, a predetermined length of chain equal to the stroke of the crank arm will now be exposed beneath the bottom of the tube. At this point, the cutter assembly 38 is activated such that the cutting element 104 moves across the lower surface of the plate 26 so as to shear off such predetermined length of chain. The chain then drops by gravity as previously mentioned into the pick up area 43. The cycle may then be automatically repeated. It should also be pointed out that the chain cutting assembly 38 need not be activated on each reciprocal stroke of the plate 26. For instance, when it is desired to obtain a predetermined chain length which is greater than the maximum stroke of the crank arm 60, then the plate 26 may be cycled a multiple number of times such that the product of the number of cycles and the length of the stroke will equal the desired predetermined length of chain. In such arrangement, the chain cutting assembly 38 is fired only at the end of such desired number of plate cycles.

Figure 2:
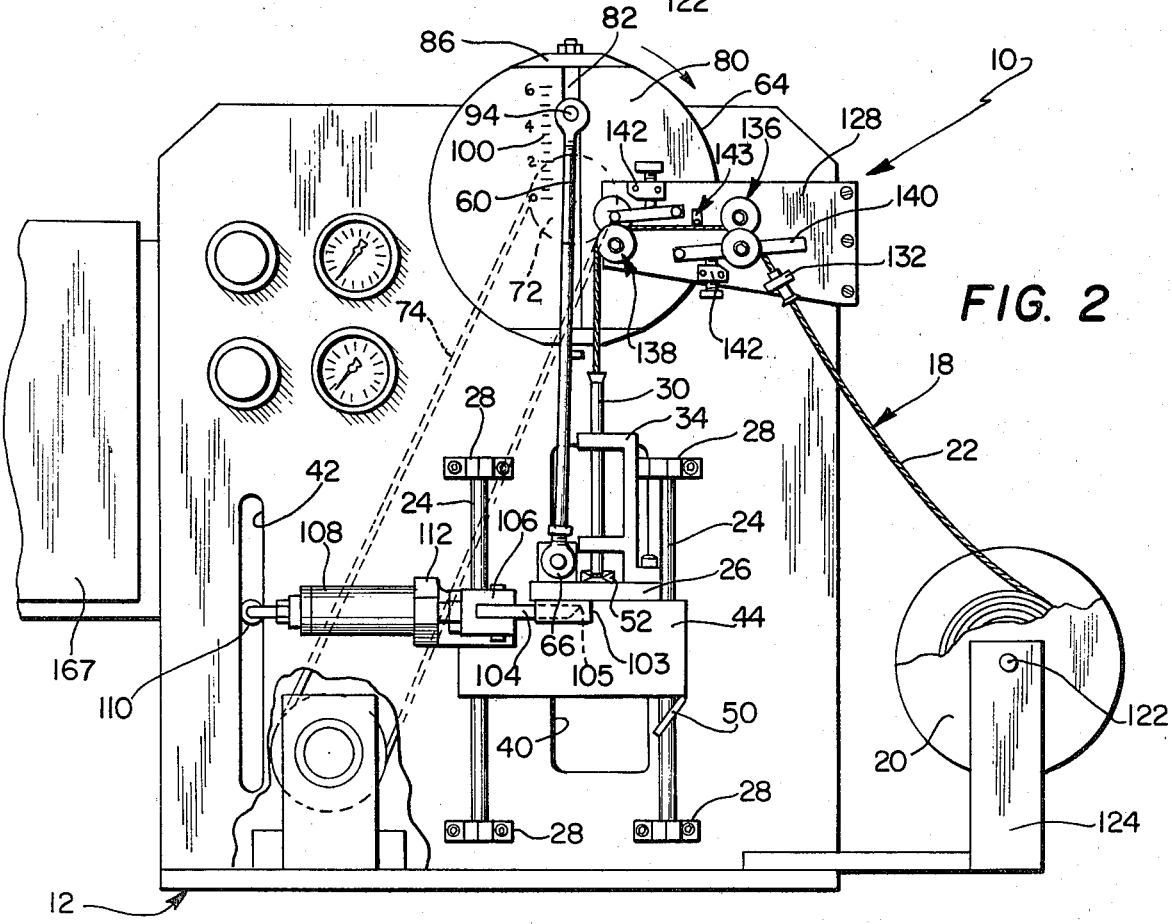
FIG. 2 is a front elevational view thereof.
Figure 3:
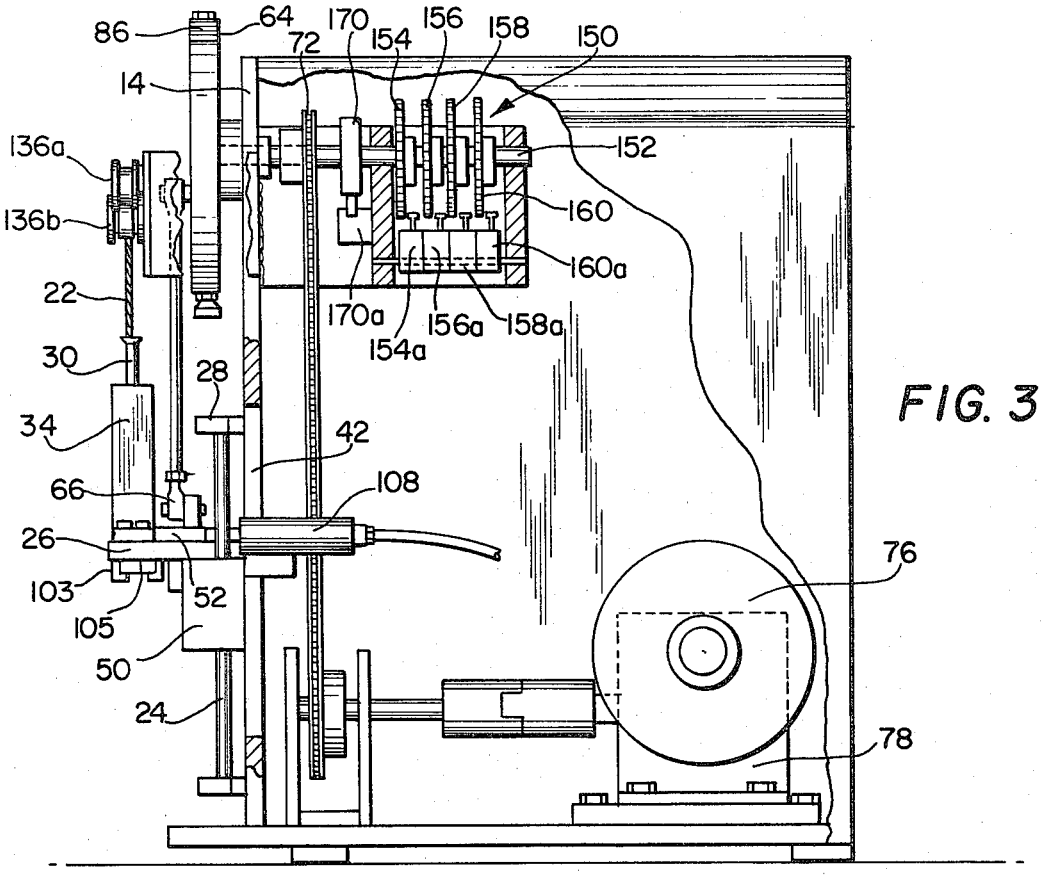
FIG. 3 is a side elevational view thereof with parts broken away and sectioned for clarity.
Figure 4:
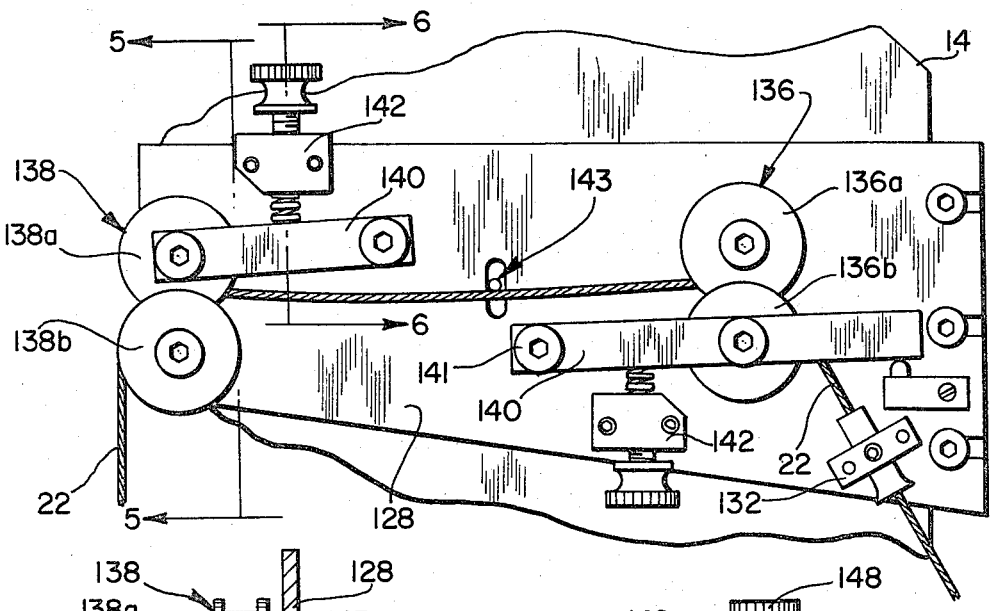
FIG. 4 is an enlarged front elevational view of a part of the feed chain assembly of such machine.
Figure 5:
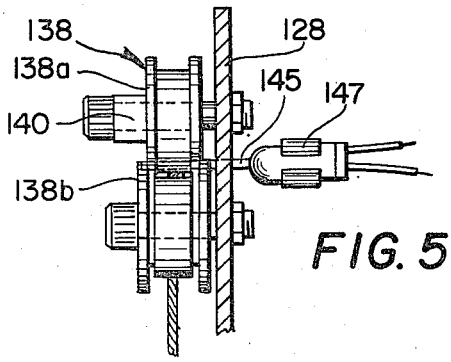
FIG. 5 is a sectional view taken along the line 5—5 of FIG. 4.
Figure 6:
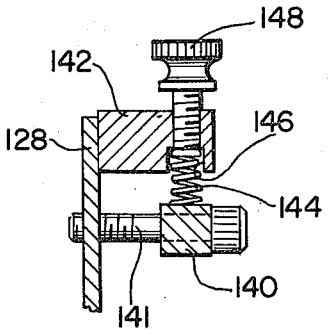
FIG. 6 is a sectional view taken along the line 6—6 of FIG. 4.
Figure 7:
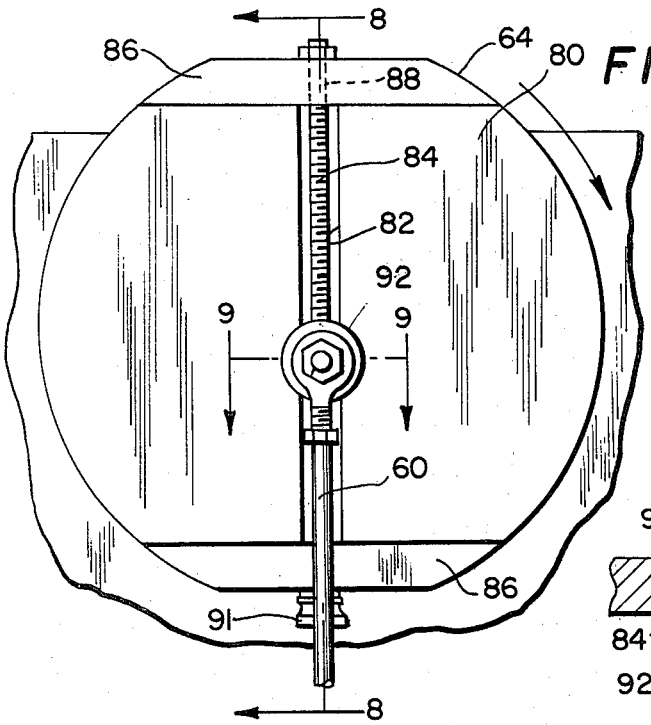
FIG. 7 is an enlarged front elevational view of a portion of the drive system of the present machine.
Figure 8:
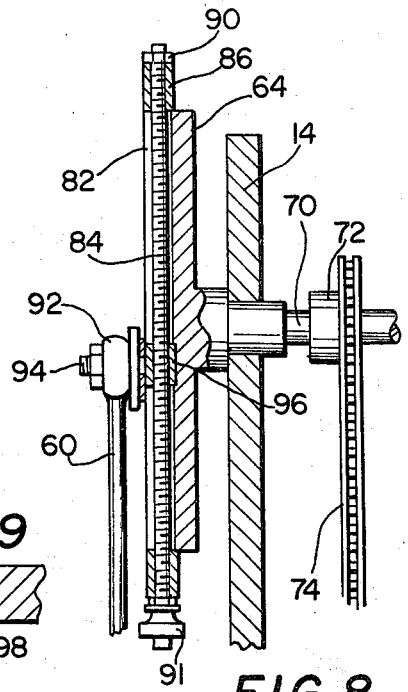
FIG. 8 is a sectional view taken along the line 8—8 of FIG. 7.
Figure 9:
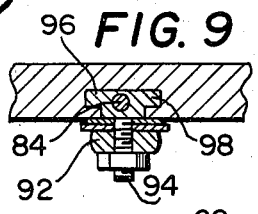
FIG. 9 is a sectional view taken along the line 9—9 of FIG. 7.

Turning now to FIGS. 4 through 6 in conjunction with FIGS. 1 and 2, the particular constructional configuration of the chain supply assembly 18 will be most apparent. As previously mentioned such includes a reel 20 on which a supply of chain 22 is wound and which in turn is supported for rotation on an axle 122. The axle 122 is mounted within a cradle element 123 having upright supporting trunions 124. The cradle 123 is in turn attached to the frame 112 in any convenient manner.

The chain supply assembly 18 further includes an alignment and tensioning assembly 126. Such assembly 126 includes a relatively flat arm 128 attached at one end thereof to the frame 12 by means of a right angle bracket 130. The arm 128 thus extends across the outer face of the disc 64. The arm 128 includes a directional guide 132 and first and second sets of tensioning rollers 136 and 138 respectively. The first roller set 136 includes a first fixed roll **136*a* and a tensioning roll 136*b*. The tensioning roll 136*b* is in turn rotatably mounted on a lever 140 intermediate the length thereof. The lever 140 is in turn pivotally attached to the arm 128 and further includes a tension block 142. The tension block 142 is attached to the plate 128 and includes a spring 144 mounted within a pocket 146 provided in the undersurface thereof and through which a thumb screw 148 may be engaged as to increase the compression thereof. The other end of the spring 144 is adapted to contact the lever 140 such that the relative pivotal force applied thereto may be regulated. It should be brought out that as the force on the spring 144 is increased, then the force at which the pivotally mounted roller 136*b* engages the fixed roller 136*a* also increases. This construction enables a greater or lesser amount of drag or tension to be applied to the chain 22 disposed in contact between the rollers 136*a* and 136*b* as best shown in FIG. 5. The lever 140 is pivotally attached to the plate 128 by means of a pivot pin 141**.

The second set 138 of rollers **138*a* and 138*b* is similarly provided with an identical tensioning device 142 such that the chain run disposed between such sets is relatively taut. A safety switch 143 is mounted on the plate 128 at a point positioned above the chain run intermediate such roller sets 136 and 138 such that an outwardly extending finger 145 is adapted to rest on top of the chain 22. When for any reason there is no chain between the roll sets 136 and 138, the finger 145 will move downwardly thus activating an electrical device such as a mercury switch 147 so as to turn off motor 76 and accordingly shut down the machine 10. The lowermost roll 138*b* of the second roll set is also positioned on the plate 128 in such a location that the periphery of such roll 138*b* in contact with the chain 22 serves to position such chain in vertical alignment with the open end of the tube 30. In this regard, it should also be brought out that the presence of the tube 30 reduces any natural sway or movement of the chain 22 during operation of the device and has been found to greatly contribute to the accuracy and reproducability of the machine. The proximate spacing of the open lower end of the tube 30 with regard to the upper surface of the plate 126 also insures accurate chain positioning such that the chain may be repeatedly gripped and released by the gripping jaws 52 in the intended manner. Also, by regulating the amount of frictional drag by adjustment of the tensioning devices 142 of the roller sets 136 and 138, any tendency for the chain to continue to be fed once the plate 26** reaches it lowermost position is eliminated.

The various functions of the machine 10 are brought about by the control assembly 150 best shown in FIGS. 11 and 12 of the drawings. The drive shaft 70 is arranged parallel to a stub shaft 152 on which a series of switch gears 154, 156, 158 and 160 are mounted. The drive shaft includes a drive gear 162 meshed with the switch gear 154 and through which rotation of the stub shaft 152 is brought about. The size and number of teeth on drive gear 162 is such that an even multiple of rotations of such gear causes a single rotation of each of the gears 154, 156, 158 and 160. The particular arrangement shown is such that rotation of gear 162 six (6) times causes a single rotation of the switch gears 154, 156, 158 and 160. In addition, another switch gear 164 is mounted on a second stub shaft 166 and meshed with drive gear 162. The size and number of teeth provided in switch gear 164 is such that four (4) rotations of gear 162 causes a single rotation of gear 164. Each of the switch gears are provided with one or more actuation fingers 165 dependent on the number of rotations of shaft 70 to be permitted prior to firing the cutting assembly 38. The switch gears 154, 156, 158, 160 and 164 each have an associated electrical switch **154*a*, 156*a*, 158*a*, 160*a* and 164*a*, activation of which is capable of firing the cutting assembly when such switch is electrically alive and is activated. A control box 167 is mounted on the frame and through which appropriate circuitry electrically activates one of the switches 154*a*, 156*a*** etc.

The switch gear 154 has six (6) actuation fingers 165 equally spaced about its periphery such that each rotation of shaft 70 causes the switch **154*a* to fire the cutting assembly assuming that switch 154*a* is electrically activated by the control panel 167. Switch gear 156 is provided with three equally spaced fingers 165, switch gear 158 with two equally spaced fingers, and switch gears 160 and 164 with a single actuation finger 165. From the above it may be seen that if a chain length is desired which is equal to or less than the maximum travel of crank arm 60 and thus the travel of plate 26, that switch 154*a* would be selected for potential activation by control panel 167 such that one of the six fingers 165 provided on switch gear 154 would activate (close the circuit associated with switch 154*a*) each time the plate 26 cycles. If a multiple of 2 cycles were required, switch 156*a* would be activated. For three cycles, switch 158*a*; for four cycles switch 164*a*; and for six cycles, switch 160*a*. Thus, various multiples of a single complete stroke of the crank arm 60 can be selected for firing of the cutter assembly 38 as above discussed so that various lengths of chain may be provided. Rotation of a cam 170 mounted on the shaft 70 is utilized to open and close the gripping jaws 52 in relation to the upper and lower positions of the plate 26. A switch 170*a* associated with the cam 170 is connected through appropriate circuitry to the chain gripping assembly 36 such that the jaws 52 grip the chain during the downward travel of plate 26** and release the chain during the upward travel thereof.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A machine for cutting strand material such as chain to a variable and predetermined length comprising a frame, a plate mounted on said frame for vertical reciprocation relative thereto between upper and lower positions, an open ended tube mounted on said plate and adapted to receive chain from a chain supply assembly adapted to supply chain to the open upper end of said tube, chain pulling means mounted on said plate and adapted to grip chain emerging from the bottom end of said tube when said plate is at said upper position thereof so as to pull a selected length of said chain through said tube during the downward travel of said plate and to release said chain at the lower position of said plate, a chain cutting assembly supported by said frame and adapted to move in conjunction with said plate and adapted to sever a predetermined length of said chain from the supply thereof, and means for varying the reciprocal travel of said plate relative to said frame so as to vary the length of chain pulled from said supply on each reciprocal cycle thereof.

2. The chain cutting machine of claim 1, said pulling means including a pair of opposed gripping jaws, said tube adapted to orient the chain with respect to both said gripping jaws and said cutting assembly.

3. The chain cutting machine of claim 2, said plate including an opening therethrough, said opening aligned with but spaced from said tube and adapted to receive chain pulled from said supply thereof on the downward stroke of said plate, said gripping jaws positioned in the space between said tube bottom and said plate.

4. The chain cutting machine of claim 1, said means for varying the reciprocal travel of said plate including a rotatable disc having a crank arm attached thereto, said crank arm in turn connected to said plate such that one complete rotation of said disc moves said plate through a complete cycle thereof from its upper position to its lower position and then back to said upper position.

5. The chain cutting machine of claim 4, said disc having a diametrically oriented slot in turn having a threaded rod longitudinally disposed in said slot, a slide threadably mounted on said rod and having an element pivotally connected in said crank at its upper end whereby adjustment of said slide relative to said rod regulates the vertical travel of said plate.

6. The chain cutting machine of claim 4, drive means for rotating said disc, a control assembly associated with said drive means, said control assembly including means adapted to force said gripping jaws together and apart at said upper and lower plate positions respectively, and separate means for controlling said cutting assembly such that multiple cycles of said plate may occur between activation intervals of said cutting assembly so that chain lengths corresponding to multiples of said vertical plate travel may be produced.

7. The chain cutting machine of claim 6, said control assembly including a series of spaced gears mounted on a shaft in turn driven in conjunction with said disc, a separate switch associated with each of said gears and switch activation elements mounted on said gears so as to activate its respective switch upon a different number of cycles of said disc.

8. The chain cutting machine of claim 1, said chain supply assembly including a reel having a supply of chain wound thereon, a tension station for frictionally gripping said chain proximate the upper end of said tube and through which resistance to pulling said chain from said reel may be regulated, and safety means intermediate said tension station and said reel for sensing the pressure or absence of chain thereat.

9. The chain cutting machine of claim 8, said tension station including a spaced first and second pairs of grooved wheels adapted to frictionally engage said chain and a length of chain between said wheel pairs, said safety means comprising an arm adapted to contact said chain length and a machine shut off switch associated with said arm.

* * * * *